United States Patent [19]

Baumann

[11] Patent Number: 4,464,180

[45] Date of Patent: Aug. 7, 1984

[54] COMPOSITIONS AND METHOD FOR DYEING OR PRINTING WITH DISPERSE DYES

[75] Inventor: Hans-Peter Baumann, Ettingen, Switzerland

[73] Assignee: Sandoz Ltd., Basel, Switzerland

[21] Appl. No.: 452,461

[22] Filed: Dec. 23, 1982

[30] Foreign Application Priority Data

Jan. 2, 1982 [DE] Fed. Rep. of Germany ..... 3200003
May 3, 1982 [DE] Fed. Rep. of Germany ..... 3216462
Jul. 12, 1982 [DE] Fed. Rep. of Germany ..... 3226053

[51] Int. Cl.[3] ..... D06P 1/56; C07C 41/18; C07F 9/09

[52] U.S. Cl. ..... 8/557; 8/922

[58] Field of Search ..... 8/557

[56] References Cited

U.S. PATENT DOCUMENTS 2,454,541 11/1948 Bock et al. ..... 260/53
3,236,583 2/1966 Hees ..... 8/582
3,919,429 11/1975 Grossmann et al. ..... 424/358
4,101,273 7/1978 Matsuba et al. ..... 8/609

FOREIGN PATENT DOCUMENTS 1136807 12/1982 Canada .
1425391 2/1975 United Kingdom .

*Primary Examiner*—A. Lionel Clingman
*Attorney, Agent, or Firm*—Gerald D. Sharkin; Richard E. Vila; Thomas C. Doyle

[57] ABSTRACT

A method for dyeing or printing a textile substrate with disperse dyes comprising using a compound of formula I

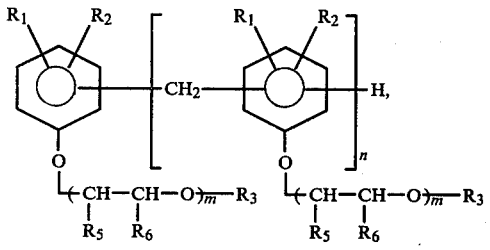

(I)

wherein each $R_1$, independently, is $C_{4-14}$alkyl each $R_2$, independently, is H or $C_{1-10}$alkyl with the proviso that the sum of the carbon atoms present in $R_1$ and $R_2$ borne by the same phenyl ring is from 6 to 18 an average of 0.5 to n of the $R_3$'s are $—SO_3R_4$, $—CH_2CO_2R_4$ or $$O{=}\overset{|}{P}(OH)_2,$$

the remaining $R_3$'s being H each $R_4$, independently, is H, an alkali metal, an equivalent of an alkali earth metal, ammonium, or substituted ammonium, $R_5$ and $R_6$ are both H, with the proviso that in, on average, up to 60% of the units $—CHR_5—CHR_6$—one of the groups $R_5$ or $R_6$ may be methyl, each m, independently, is an integer from 4 to 20, and n is an integer from 1 to 9, or a mixture thereof together with a dyeing assistant.

25 Claims, No Drawings

COMPOSITIONS AND METHOD FOR DYEING OR PRINTING WITH DISPERSE DYES

The present invention relates to emulsifying agents which may be used together with sparingly soluble dyeing assistants for dyeing and printing with disperse dyes.

The invention provides a method for dyeing or printing a textile substrate with disperse dyes comprising using a compound of formula I

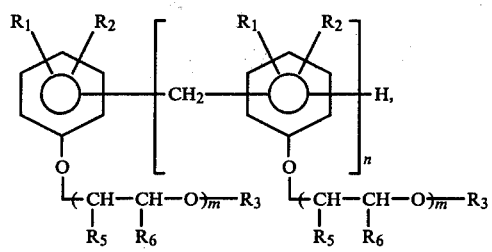

(I)

wherein each $R_1$, independently, is $C_{4-14}$alkyl each $R_2$, independently, is H or $C_{1-10}$alkyl with the proviso that the sum of the carbon atoms present in $R_1$ and $R_2$ borne by the same phenyl ring is from 6 to 18 an average of 0.5 to n of the $R_3$'s are $—SO_3R_4$, $—CH_2CO_2R_4$ or $$O{=}\overset{|}{P}(OH)_2,$$

the remaining $R_3$'s being H each $R_4$, independently, is H, an alkali metal, an equivalent of an alkali earth metal, ammonium, ammonium substituted by up to four $C_{1-4}$alkyl or up to three $C_{2-4}$ $\beta$, $\gamma$- or $\delta$-hydroxyalkyl, or cycloimmonium group $R_5$ and $R_6$ are both H, with the proviso that in, on average, up to 60% of the units $—CHR_5—CHR_6—$ one of the groups $R_5$ or $R_6$ may be methyl, each m, independently, is an integer from 4 to 20, and n is an integer from 1 to 9, or a mixture thereof together with a dyeing assistant.

Any alkyl as $R_1$ or $R_2$ may be branched or straight chain.

Preferably $R_1$ is $R_1'$ where $R_1'$ is straight chain $C_{6-12}$alkyl, preferably octyl, nonyl or dodecyl. $R_1$ is preferably in the para position to $—CHR_5CHR_6)_mR_3$.

Preferably $R_2$ is $R_2'$ where $R_2'$ is hydrogen or $C_{1-6}$alkyl, more preferably hydrogen or methyl.

Preferably an average of 0.5 to n/2 $R_3$'s per molecule have a significance selected from $—SO_3R_4'$ and $—CH_2CO_2R_4'$, the remaining $R_3$'s being hydrogen. More preferably 1 to n/2 $R_3$'s are $—SO_3R_4'$ or $—CH_2CO_2R_4'$, the remaining $R_3$'s being hydrogen.

When $R_4$ is substituted ammonium, it is preferably di-$C_{1-4}$-alkylammonium e.g. dimethylammonium, triethylammonium or mono- , di- or triethanolammonium. The cycloimmonium group as $R_4$ is an ammonium group incorporated in a cyclic system which may contain further heteroatoms. When $R_4$ is cycloimmonium it is preferably piperidinium.

$R_4$ is preferably $R_4'$ where $R_4'$ is hydrogen, ammonium, sodium, potassium or one calcium or magnesium equivalent. More preferably $R_4$ is $R_4''$ where $R_4''$ is hydrogen, sodium or ammonium.

Preferably all the units $—CHR_5CHR_6—$ are ethylene or an average of up to 40% of the units are 1,2-propylene and the remaining groups are ethylene.

m is preferably m' where m' is an integer from 6 to 15.

n is preferably n' where n' is an integer from 1 to 6.

Preferred compounds of formula I are those wherein each $R_1$ and $R_2$, independently, is $R_1'$ and $R_2'$ respectively, each m independently is m', n is n', the units $—CHR_5CHR_6—$ are ethylene or an average of up to 40% of the units are 1,2-propylene and the remaining are ethylene, and 0.5 to n/2, more preferably 1 to n/2 $R_3$'s are $—SO_3R_4'$ or $—CH_2CO_2R_4'$, more preferably $—SO_3R_4''$ or $—CH_2—CO_2R_4''$, the remaining $R_3$'s being hydrogen.

The compounds of formula I wherein at least one of the $R_3$'s is other than $—SO_3R_4$ are new.

The compounds of formula I can be prepared as described in GB Patent Specification Nos. 1,388,251 and 1,425,391. They are produced by condensation of a monoor dialkylphenol or a mixture thereof with formaldehyde in the presence of an acid catalyst, advantageously under a nitrogen atmosphere. The alkoxylation of the resulting polynuclear compounds may be effected according to known methods either with ethylene oxide or a mixture of ethylene oxide and 1,2-propylene oxide or alternately.

Sulphation of the alkoxylated product may be carried out in known manner. Suitable sulphating agents include concentrated sulphuric acid, oleum, $SO_3$ or sulphamic or chlorosulphonic acid. Depending on the sulphation conditions, the alkoxylated compounds may be obtained as the sulphuric acid semi-ester either in the acid or salt form. The semi-ester in the acid form may be converted into the salt form by neutralization with an organic or inorganic base, e.g. an alkali metal or alkali earth metal oxide or hydroxide, ammonia, di-$C_{1-4}$alkylamine, ethanolamine, piperidine and the like.

The compounds of formula I wherein 0.5 to n $R_3$'s are $—CH_2CO_2R_4$ may be prepared according to the known carboxymethylation methods, e.g. by reacting the alkoxylated polynuclear product with monochloroacetic acid or a corresponding salt thereof, e.g. the sodium, potassium or ammonium salt. When the alkoxylated product is carboxymethylated with $—CH_2CO_2H$ groups, such acid groups may be converted into the desired salt by neutralization with an appropriate base.

The compounds of formula I wherein 0.5 to n $R_3$'s are $$O{=}\overset{|}{P}(OH)_2$$

may be produced in accordance with known methods, e.g. by reaction with $P_2O_5$ or polyphosphoric acid and, if desired, in the presence of an organic solvent.

The amount of sulphating, carboxymethylating or phosphating agent used is such that the compounds are sulphated, carboxymethylated or phosphated to the indicated extent.

The compounds of formula I are useful emulsifying agents having good surface-active and dispersing properties. They are particularly efficient for emulsifying dyeing assistants which are sparingly soluble in the dyebath at the dyeing temperature, e.g. dyeing accelerators, carriers or levelling agents.

According to the invention a dyeing assistant, e.g. such as employed for dyeing with disperse dyes, is used together with one or more compounds of formula I. The dyeing assistant and the compound of formula I may be added either in form of a composition or separately to the dyebath, padding liquor or printing paste. Preferably they are used as a composition. Such compositions comprising one or more dyeing assistants and one or more compounds of formula I form part of the invention.

The compositions of the invention contain the dyeing assistant and the compound of formula I in a weight ratio of the former to the latter ranging from 60:40 to 90:10, preferably from 70:30 to 85:15.

Preferred dyeing assistants which can be mixed with the compounds of formula I are carriers. Carriers are compounds generally used for dyeing polyester fibres. Suitable carriers include chlorinated aromatic hydrocarbons, particularly chlorobenzenes; alkylbenzenes; diphenyl; diphenylether; ditolylether; methylnaphthalene; o- or p-phenylphenol; cyclohexylphenol; dibenzofuran; benzyl benzoate; $C_{1-12}$alkyl benzoates; and mono- or polyesterification products of polyols with benzoic acid.

Preferred compositions of the invention are those comprising at least one compound of formula I and a carrier selected from (a) mixtures of alkylbenzenes having a boiling point range above 140° C., preferably from 145° to 280° C.;
(b) the product of mono- or polyesterifying an aliphatic polyol or ether-polyol or a disaccharide with benzoic acid or benzoic acid substituted on the phenyl ring by up to three substituents selected from chlorine, $C_{1-4}$alkyl and $C_{1-4}$alkoxy; and
(c) a $C_{1-12}$alkyl; $C_{1-4}$alkoxy $C_{1-6}$alkyl; benzyloxy $C_{1-6}$alkyl; or cycloalkyl ester of phthalic acid or phthalic acid monosubstituted on the benzene nucleus by chlorine, $C_{1-3}$alkyl or $C_{1-2}$alkoxy.

The alkylbenzenes (a) are for example the distillation residues from industrial production of ortho-, meta- or paraxylenes or other alkylbenzenes, from industrial cracking and hydrogenation processes and the like. Preferred alkylbenzenes are those having two or more methyl groups or at least one ethyl, propyl or butyl groups on the benzene nucleus.

Preferred esters (b) are the products of mono- or polyesterifying an aliphatic $C_{2-8}$diol, e.g. ethylene glycol, 1,2- or 1,3-propanediol, butanediols, pentanediols or hexanediols, an aliphatic $C_{3-6}$triol, e.g. glycerol and other aliphatic polyols such as pentaerythritol, glucose and the like, an ether-polyol such as an ether-diol of formula II $$HO—C_rH_{2r}—O—C_pH_{2p})OH \qquad II$$

wherein r and p, independently, are 2, 3 or 4, or a disaccharide such as sucrose.

The esters (b) may be produced according to known methods, e.g. by transesterification with an excess of the polyfunctional alcohol of a $C_{1-4}$alkyl benzoic acid ester either unsubstituted or substituted on the benzene nucleus as indicated above. Depending on the polyfunctional alcohol used, mixtures of fully and partially esterified compounds, e.g. mono- and di-benzoates of diols or ether-diols of formula II, may be obtained. These mixtures may also contain small amounts of unesterified starting material which does not adversely affect the properties of the dyeing assistant or emulsifying agent of formula I.

The carriers (c) are known compounds or may be prepared in known manner.

In addition to the dyeing assistant(s) and the compound(s) of formula I, the compositions of the invention may contain further ingredients, e.g. oleic acid or $C_{1-4}$alkyl $C_{14-18}$ fatty acid ester and, if desired, an antifoaming agent e.g. paraffin oil or a silicone. In addition to the carrier(s), the composition may contain further dyeing assistants e.g. a levelling agent, or further emulsifying agents, e.g. anionic, non-ionic, amphoteric or slightly cationic emulsifying agents. Preferably the compositions of the invention contain, as emulsifying agent, one or more compounds of formula I and, as dyeing assistant, a carrier or a mixture of carriers.

The compositions may be either in solid, liquid or paste form. Preferably they are used as an aqueous emulsion or as a solution in a solvent, e.g. a lower alcohol such as ethanol, isopropanol or the like. The compositions of the invention may be prepared by known methods, e.g. by mixing the ingredients with a stirrer at room temperature.

The compositions of the invention are added to the dyebath, padding liquor or printing paste in amounts generally ranging from 0.5 to 30 g/l, preferably from 1 to 5 g/l. Preferably the padding liquors or printing pastes contain the composition in an amount from 0.5 to 3 times the amount of disperse dyes.

Suitable textile substrates which may be dyed or printed according to the invention are those consisting of or comprising synthetic or semi-synthetic hydrophobic, high molecular weight organic textile materials, e.g. polyester, cellulose triacetate, cellulose 2½ acetate and synthetic polyamides, especially linear, aromatic polyester.

Dyeing, padding and printing using a mixture of a dyeing assistant and a compound of formula I may be carried out in accordance with known methods. Preferably the composition (comprising dyeing assistant and compound of formula I) are used for exhaust dyeing under normal or high pressure, at a temperature up to 140° C., depending on the textile substrate. Polyester is preferably dyed at a temperature from 110° to 140° C., polyamide, particularly aromatic polyamide, e.g. Quiana (Registered Trade Mark) at a temperature up to 115° C. and cellulose triacetate at a temperature up to 125° C. Textile substrates comprising polyester may also be dyed in the presence of the composition of the invention according to the known "rapid" dyeing method. Rapid dyeing is an exhaust dyeing process where the heating rate of the dyebath is quicker and the dyeing time significantly shorter than in the conventional polyester dyeing processes.

The compounds of formula I give immediately by simple stirring a stable and finely distributed emulsion with the dyeing assistant, especially the carriers. This property is maintained in the dyebath, padding liquor or printing paste, even at the high dyeing temperature. The compounds of formula I enhance the action of the dyeing assistant. In admixture with a carrier, they facilitate a rapid penetration of the disperse dyes into the fibres and promote level dyeings even on striped material. The compounds of formula I are virtually odourless, practically non-volatile and biodegradable. They do not affect the fastness properties of the disperse dyeings or printings. Furthermore, they promote a high dyeing yield while shortening the dyeing and/or fixation time. The resulting dyeings and printings have an excellent levelness.

The composition of the invention may also be used for the aftertreatment of unevenly dyed polyester. A polyester substrate which has been conventionally dyed in an uneven shade is aftertreated in an aqueous bath containing the mixture of a compound of formula I and a dyeing assistant in an amount as indicated for the dyeing. This aftertreatment is carried out at a temperature from 95° to 130° C. for up to two hours. Dyeings with an excellent levelness are thus obtained.

The following Examples further serve to illustrate the invention. In the Examples all parts and percentages are by weight and all temperatures in degrees Centigrade.

EXAMPLE 1

100 Parts polyester fabric are introduced at 40° in a dyebath containing 4000,0 parts water
8.0 parts anhydrous ammonium sulphate
0.8 parts of the commercially available dye C.I. Disperse Blue 87 (containing a dispersing agent, and
6.0 parts of a dyeing assistant mixture containing 80% butyl benzoate and 20% of the compound 6 of Table 2.

The dyebath is adjusted to pH 5 with formic acid and then heated to about 97° over 30 minutes. Dyeing is carried out for 1 hour at this temperature and then the substrate is rinsed, washed, rinsed and dried. There is obtained an excellent blue dyeing.

Analogous good results are obtained when the dyeing assistant mixture is replaced either by 6 parts of a mixture containing 75% butyl benzoate, 5% biphenyl and 20% of the compound 6 of Table 2, or by 8 parts of a mixture containing 85% 1- and 2-methylnaphthalene and 15% parts of the compound 6 of Table 2 or 6 parts of a mixture containing 80% trichlorobenzene and 20% of the compound 6 of Table 2.

EXAMPLE 2

5 Parts scoured polyester are introduced at 70° in a HT-dyeing machine in 100 parts of a dyebath containing:

0.1 part of the commercially available dye C.I. Disperse Blue 148 (containing a dispering agent)
2.0 parts ammonium sulphate
0.35 parts of an alkylbenzene mixture comprising circa 25% trimethylbenzene, 45% ethyltoluene, 10% n-butylbenzene and 20% sec. and tert.-butylbenzene, and
0.05 parts of the compound 8 of Table 2 and is adjusted to pH 5 with formic acid.

After the dyeing machine has been closed, the temperature of the dyebath is raised to 130° over 20 minutes and maintained at 130° for 20 minutes. After cooling, the substrate is taken out, rinsed, soaped, rinsed again and dried.

The substrate is evenly dyed in a deep blue shade with excellent fastness properties. The spent dyebath is fully exhausted.

By following the procedure of Example 1 or 2 but replacing the dyeing assistant mixture by any combination of the carriers of Table 1 with the emulsifying agents of Table 2, very good dyeings are obtained.

The dyes C.I. Disperse Red 73 or C.I. Disperse Blue 183 may for example be used instead of C.I. Disperse Blue 148.

TABLE 1

(Carriers)

(a) commercially available mixture of circa 0.5% ethylbenzene, 1% p-xylene, 2% m-xylene, 3% o-xylene, 1% isopropylbenzene, 20% m- and p-ethyltoluene, 7% 1,3,5-trimethylbenzene, 6.5% o-ethyltoluene and isobutylbenzene, 30% 1,2,4-trimethylbenzene, 4.5% n-propylbenzene, 0.5% sec.-butylbenzene, 1.5% 1,3-diethylbenzene, 8.5% 1,4-diethylbenzene, n-butylbenzene and 1,2,3-trimethylbenzene, 1% 4-tert.-butyltoluene, 2% 1,2-diethylbenzene, 2% indole, 9% higher mol-wt. aromatics (boiling point range 160°–240°);

(b) aromatic hydrocarbon mixture containing essentially alkylbenzenes $C_{10}$; by-product from industrial cracking); $d_4^{20}=0.840–0.893$; boiling point range 180°–210°;

(c) mixture of 1.4% ethylbenzene, 4.7% sec.-butylbenzene, 84.7% diethylbenzenes (boiling point 182°–185°), 4.8% 1,3,5-triethylbenzene, 4.2% 1,2,4-triethylbenzene and 0.2% tetraethylbenzene;

(d) mixture of 5% 1,2,3-trimethylbenzene, 10% 1,3,5-trimethylbenzene and tert.-butylbenzene, 16% 1,2,4-trimethylbenzene and sec.butylbenzene, 27% o-, m- and p-ethyltoluene, 8% n-propylbenzene, 3% isopropylbenzene, 5% n-butylbenzene, 20% diphenyl, 1% naphthalene and 5% anthracene, phenanthrene and fluorene;

(e) mixture of 1- and 2-methylnaphthalene;

(f) trichlorobenzenes (mixture of isomers)

TABLE 2

(Compounds of formula I)

The compounds of formula I are prepared according to GB Patent Specification No. 1,425,391. The conversion into the sulphuric semi-ester is preferably carried out with amidosulphonic acid. However, it can also be effected with concentrated sulphuric acid, oleum or $SO_3$. The sulphuric semi-ester in acid form may be neutrolized with an alkali metal or alkali earth metal derivative, e.g. NaOH, KOH, MgO or calcium hydroxide, ammonia or an organic base e.g. di-$C_{1-4}$alkylamine, ethanolamine or piperidine.

In the compounds 1 to 17 and 19 to 21 indicated in the following Table 2, $R_1$ is nonyl, in the compound 18 $R_1$ is dodecyl and in each of these compounds $R_2$ is hydrogen.

The amount of formaldehyde mols used for the production of the compounds of formula I of the Table 2 is 1 unit less than the number of phenol mols.

TABLE 2

| Compound | Phenol mols | Ethylene oxide mols | Propylene oxide mols | Amidosulphonic acid/mols |
|---|---|---|---|---|
| 1 | 9 | 60 | — | 1 |
| 2 | 9 | 180 | — | 3 |
| 3 | 9 | 140 | 20 | 3 |
| 4 | 9 | 120 | — | 2.5 |
| 5 | 7 | 100 | — | 3 |
| 6 | 7 | 50 | — | 1 |
| 7 | 7 | 40 | 10 | 1.5 |
| 8 | 7 | 70 | — | 1.5 |
| 9 | 7 | 75 | — | 1 |
| 10 | 5 | 20 | — | 1.5 |
| 11 | 5 | 100 | — | 2.5 |
| 12 | 3 | 20 | — | 1 |
| 13 | 3 | 20 | 20 | 0.5 |
| 14 | 3 | 20 | 20 | 1.5 |
| 15 | 2 | 20 | — | 1 |
| 16 | 3 | — | — | 2 |

TABLE 2-continued

| Compound | Phenol mols | Ethylene oxide mols | Propylene oxide mols | Amidosulphonic acid/mols |
|---|---|---|---|---|
| 17 | 2 | 8 | — | 1.25 |
| 18 | 2 | 40 | — | 1 |
| 19 | 3 | 60 | — | 1.5 Sodium monochloro acetic acid salt |
| 20 | 9 | 120 | — | 3 |
| 21 | 7 | 50 | — | 1.5 |
| 22 | 7 | 50 | — | 0.5 $P_2O_5$ |

Particularly preferred compositions are those comprising either 80 to 95% alkyl aromatic hydrocarbons, e.g. the mixtures
(a) or (b) of Table 1, and
20 to 5% emulsifying agent of formula I as indicated in Table 2, especially the compounds 6, 8, 9 and 14 of Table 2
or 70 to 90% butyl benzoate
0 to 10% diphenyl
and for the remaining a compound of formula I as indicated in Table 2, especially the compound 6, 8, 9 and 14.

The esters indicated in the following Table (3) are produced by transesterification of 2 mols methyl benzoate with the corresponding di- or polyol. The products numbered 1 to 13 are mixtures obtained from the reaction of 2 mols methyl benzoate. The compounds 14 to 18 are pure esters. These esters can be used in admixture with a compound of formula I.

TABLE 3

| No. | Esters | | |
|---|---|---|---|
| 1 | Transesterification with | 1.1 mols | ethylene glycol |
| 2 | Transesterification with | 1.2 mols | 1,3-propanediol |
| 3 | Transesterification with | 1.2 mols | 1,2-propanediol |
| 4 | Transesterification with | 1.2 mols | 1,4-butanediol |
| 5 | Transesterifiaction with | 1.2 mols | 1,3-butanediol |
| 6 | Transesterification with | 1.2 mols | diethylene glycol |
| 7 | Transesterification with | 0.5 mols | ethylene glycol |
| | and | 0.6 mols | 1,2-propanediol |
| 8 | Transesterification with | 0.5 mols | ethylene glycol |
| | and | 0.6 mols | 1,4-butanediol |
| 9 | Transesterification with | 0.35 mols | ethylene glycol |
| | | 0.35 mols | 1,3-propanediol and |
| | | 0.35 mols | 1,4-butanediol |
| 10 | Transesterification with | 1.2 mols | hexylene glycol |
| 11 | Transesterification with | 0.93 mols | glycerol |
| 12 | Transesterification with | 1.2 mols | neopentyl glycol |
| 13 | a sucrose benzoate mixture of the general formula $[C_{12}H_{14}O_3(CH)_{0.9}(O—CO—C_6H_5)_{7.1}]$ | | |
| 14 | diethylene glycol dibenzoate | | |
| 15 | dipropylene glycol dibenzoate | | |
| 16 | glyceryl tribenzoate | | |
| 17 | neopentylglycol dibenzoate | | |
| 18 | pentaerythritol tetrabenzoate. | | |

EXAMPLE 3

5 Parts scoured polyester are introduced at 70° in a HT-dyeing machine in 100 parts of a dyebath containing:
0.1 part of the commercially available dye C.I. Disperse Blue 148 (containing a dispersing agent)
0.32 part of mixture 1 of Table 3) (transesterification product of 2 mols methyl benzoate with 1.2 mols ethylene glycol)
0.08 part product 5 of Table 2
2.0 parts ammonium sulphate
and adjusted to pH 5 with formic acid.

After the dyeing machine has been closed, the temperature of the dyebath is raised to 130° over 20 minutes and maintained at 130° for 20 minutes. After cooling, the substrate is taken out, rinsed, soaped, rinsed again and dried.

The substrate is evenly dyed in a deep blue shade with very good fastnesses. The dyebath is completely exhausted; a sample of the dyebath taken immediately after the temperature of the dyebath has reached 130° is already exhausted to about 95%.

Analogous results are obtained when the dyeing is carried out in the presence of any mixture of a compound of Table (2) with a compound of Table (3).

EXAMPLE 4

10 Parts polyester fabric (Dacron® T 54, Du Pont) are introduced at 60° in a dyeing autoclave in 400 parts of a dyebath containing:
0.05 part of the commercially available C.I. Disperse Red 73
0.5 part of mixture 1 of Table (3)
0.15 part of compound 6 of Table 2
0.035 part diphenyl, and
3.0 parts ammonium sulphate
and adjusted to pH 5 with formic acid.

The temperature is then raised to 130° over 30 minutes and dyeing is carried out at 130° for 20 minutes. After cooling, the dyed substrate is taken out, rinsed, soaped, rinsed again and dried.

A ruby red dyeing having excellent fastness properties and a perfect levelness is thus obtained.

Analogous good results are achieved when the compounds of Table 2 and Table 3 are replaced by any one of the mixture of Table 2 or 3 or when C.I. Disperse Red 73 is replaced by C.I. Disperse Blue 183.

EXAMPLE 5

100 Parts polyester fabric which tend to give striped dyeings are introduced at 40° in 4000 parts of a dyebath containing:
0.2 part of C.I. Disperse Blue 73
9.0 parts of the mixture 2 of Table (3)
2.0 parts of the compound 12 of Table (2)
0.8 part of diphenyl
0.02 parts paraffin oil, and
8.0 parts ammonium sulphate,
and adjusted to pH 5 with formic acid.

The dyebath is then heated to 97° over 30 minutes and dyeing is carried out for 1 hour at this temperature. The dyed substrate is then washed, rinsed and dried. An even blue dyeing with very good fastness properties is obtained.

By following the same procedure but replacing the compound of formula I, the dyeing assistant and the auxiliaries by the following ingredients:
6.0 parts of the mixture 4 of Table 3
2.4 parts of the compound 21 of Table 2 or any other compound of Table 2
0.6 parts diphenyl
0.6 parts paraffin oil, and
2.4 parts n-butanol
similar good dyeing results are obtained.

EXAMPLE 6

A polyester ribbon (diolene-satin) consisting of unstretched (1:3.2) and normally stretched (1:3.66) yarn is introduced in a dyebath at 60° at a liquor to goods ratio of 40:1. The dyebath contains per 1.000 parts 3.2% (based on the weight of the substrate) of C.I. Disperse Blue 87
2 parts ammonium sulphate
4 parts citric acid, and
4 parts of a mixture containing 50% pure diethylene glycol dibenzoate (compound 14 of Table 3), 20% of the compound 4 of Table 2), 10% ditolyl ether as a technical isomer mixture, 5% paraffin oil and 5% condensate of castor oil with 32 mols ethylene oxide.

The temperature of the dyebath is then raised to 130° over 45 minutes. The substrate is dyed at this temperature for 60 minutes and then cooled, rinsed and dried. A turquoise-blue dyeing with a perfect levelness is obtained.

Similar good dyeing results are obtained when replacing the mixture above by a mixture comprising 60% of the ester mixture 9 of Table (3), 20% of the compound 6 of Table (2), 10% ethyl-hexanol, 3% diphenyl and 2% paraffin oil, or a mixture comprising 80% of a mixture as indicated in Table (3) and 20% of the compound 13 of Table (2).

Further examples of carriers based on phthalic acid esters are given in the following Table (4):

TABLE 4

1—dimethyl phthalate
2—di-n-butyl phthalate
3—di-iso-butyl phthalate
4—di-octyl phthalate
5—phthalic acid fully esterified with $C_6$-, $C_8$- and $C_{10}$-alcohols (commercially available)
6—phthalic acid fully esterified with isononanol and isodecanol (commercially available)
7—phthalic acid fully esterified with methoxyethanol (commercially available)
8—reaction product of 1 mol phthalic acid with 1.2 mols butanol.

EXAMPLE 7

By following the procedure of Example 3 but replacing the mixture 1 of Table 3 by 0.32 parts dimethyl phthalate, and compound 5 of Table 2 by 0.08 parts of the compound 1 of Table 2, results as good as in Example 3 are obtained.

Dyeings with similar good properties are obtained when using any one of compounds of formula I as indicated in Table 2 in admixture with a carrier of Table 4.

Analogous results are obtained when 0.28 parts dimethyl phthalate, 0.04 parts diphenyl and 0.08 parts of the product 8 of Table 2 is used in the procedure of Example 3.

EXAMPLE 8

By following the procedure of Example 4 but using 0.5 parts di-n-butyl phthalate and 0.15 parts of the compound 14 of Table 2, instead of the mixture 1 of Table 3 and the compound 6 of Table 2, respectively, the same good dyeing results as in Example 4 are obtained.

Analogous results are obtained when the dyeing is carried out in the presence of any mixture of a compound of Table 2 with a carrier of Table 4.

EXAMPLE 9

By following the procedure of Example 6 but using per 1000 parts 1.75 g dibutylphthalate instead of the compound 14 of Table 3, and 1.25 g of the compound 5 of Table 2 and 2 g oleic acid instead of the ditolylether, paraffin oil and ethylene oxide/castor oil condensation product, a similar turquoise-blue dyeing with the same good levelness is obtained.

In the Examples 7, 8 and 9, 10% of the amount of phthalic acid ester can be replaced by diphenyl, diphenyl oxide, ditolylether, dibenzofuran and/or $C_{4-12}$alkyl benzoate.

What is claimed is:

1. A method for dyeing or printing a textile substrate comprising treating said substrate with a dyebath, padding liquor or printing paste containing a disperse dye, a dyeing assistant and, as an emulsifying agent for the dyeing assistant, a compound or mixture of compounds of formula (I)

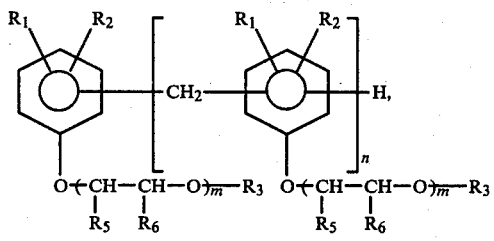

(I)

wherein each $R_1$, independently, is $C_{4-14}$alkyl, each $R_2$, independently, is hydrogen or $C_{1-10}$alkyl, with the proviso that the sum of the carbon atoms present in $R_1$ and $R_2$ borne by the same phenyl ring is from 6 to 18, the $R_3$'s are hydrogen, $—SO_3R_4'$ or $—CH_2CO_2R_4'$, with the proviso that an average of 0.5 to n/2 $R_3$'s are $—SO_3R_4'$ or $—CH_2CO_2R_4'$, each $R_4'$ independently, is hydrogen, sodium, potassium, ammonium, or one calcium or magnesium equivalent, either $R_5$ and $R_6$ are both hydrogen in each unit $—CHR_5—CHR_6—$ or in, on average, up to 60% of the units $—CHR_5—CHR_6—$ one of $R_5$ and $R_6$ is methyl and the other is hydrogen and in the remaining units $—CHR_5—CHR_6—$ both of $R_5$ and $R_6$ are hydrogen, each m, independently, is an integer from 4 to 20, and n is an integer from 1 to 9.

2. A method according to claim 1 wherein the dyeing assistant is a dyeing accelerator, a carrier or a leveling agent.

3. A method according to claim 2 in which, in the compound(s) of formula I, each $R_1$, independently, is straight chain $C_{6-12}$alkyl, each $R_2$, independently, is hydrogen or $C_{1-6}$alkyl, each m independently, is an integer from 6 to 15, n is an integer from 1 to 6, all the units $—CHR_5—CHR_6—$ are ethylene or an average of up to 40% of the units are 1,2-propylene and the remaining units are ethylene.

4. A method according to claim 2 in which the weight ratio of the dyeing assistant to the compound or mixture of compounds of formula I is from 60:40 to 90:10.

5. A method according to claim 2 in which the dyeing assistant is selected from (a) mixtures of alkylbenzenes having a boiling point range above 140° C., (b) the product of mono- or polyesterifying an aliphatic polyol or ether-polyol or a disaccharide with benzoic acid or benzoic acid substituted on the phenyl ring by up to three substituents selected from chlorine, $C_{1-4}$alkyl and $C_{1-4}$alkoxy, (c) a $C_{1-12}$alkyl-,$C_{1-4}$alkoxy $C_{1-6}$alkyl-, benzyloxy $C_{1-6}$alkyl-, or cycloalkyl ester of phthalic acid or phthalic acid monosubstituted on the benzene nucleus by chlorine, $C_{1-3}$alkyl or $C_{1-2}$alkoxy, and mixtures thereof,

6. A method according to claim 2 in which the dyeing assistant (b) is the product of mono- or polyesterifying an aliphatic $C_{2-8}$diol, an aliphatic $C_{3-6}$triol, pentaerythritol, glucose, a disaccharide or an ether diol of formula II $$HO—C_rH_{2r}—O—C_pH_{2p}—OH \qquad II$$

wherein r and p, independently, are 2, 3 or 4.

7. A method according to claim 2 in which the compound(s) of formula I and the dyeing assistant are used together in an amount from 0.5 to 30 grams per liter of dyebath, padding liquor or printing paste.

8. A method according to claim 2 in which the textile substrate consists of or comprises synthetic or semi-synthetic hydrophobic, high molecular weight organic textile materials.

9. A method according to claim 3 in which the weight ratio of the dyeing assistant to the compound(s) of formula (I) is from 60:40 to 90:10.

10. A method according to claim 4 wherein the dyeing assistant is a carrier selected from the group consisting of chlorinated aromatic hydrocarbons, alkylbenzenes, diphenyl, diphenylether, ditolylether, methylnaphthalene, o-phenylphenol, p-phenylphenol, cyclohexylphenol, dibenzofuran, benzyl benzoate, $C_{1-2}$alkyl benzoates and mono- and polyesterification products of polyols with benzoic acid.

11. A method according to claim 4 wherein, in formula (I), each $R_1$ is nonyl, each $R_2$ is hydrogen, and average of 1 $R_3$ is $—SO_3H$ and the remainder are hydrogen, each m, independently, is an integer such that the total of the m's is 50, and n is 6.

12. A method according to claim 9 wherein the dyeing assistant is a carrier selected from the group consisting of chlorinated aromatic hydrocarbons, alkylbenzenes, diphenyl, diphenylether, ditolylether, methylnaphthalene, o-phenylphenol, p-phenylphenol, cyclohexylphenol, dibenzofuran, benzyl benzoate, $C_{1-2}$alkyl benzoates and mono- and polyesterification products of polyols with benzoic acid.

13. A method according to claim 9 wherein, in formula (I)

$R_1$ is octyl, nonyl or dodecyl, $R_2$ is hydrogen or methyl, and 1 to n/2 $R_3$'s are $—SO_3R_4'$ or $—CH_2CO_2R_4'$ and the remaining $R_3$'s are hydrogen.

14. A method according to claim 9 wherein the dyeing assistant is selected from (a) mixtures of alkylbenzenes having a boiling point range above 140° C., (b) the product of mono- or polyesterifying an aliphatic polyol or ether-polyol or a disaccharide with benzoic acid or benzoic acid substituted on the phenyl ring by up to three substituents selected from chlorine, $C_{1-4}$alkyl and $C_{1-4}$alkoxy; and (c) a $C_{1-12}$alkyl-, $C_{1-4}$alkoxy $C_{1-6}$alkyl-, benzyloxy $C_{1-6}$alkyl-, or cycloalkyl ester of phthalic acid or phthalic acid monosubstituted on the benzene nucleus by chlorine, $C_{1-3}$alkyl or $C_{1-2}$alkoxy, or a mixture thereof.

15. A method according to claim 14 wherein the weight ratio of the dyeing assistant to the compound or mixture of compounds of formula (I) is 70:30 to 85:15.

16. A method according to claim 15 wherein the compound(s) of formula (I) and the dyeing assistant are used together in an amount of from 1 to 5 grams per liter of dyebath, padding liquor or printing paste.

17. A composition comprising (a) a dyeing assistant, and (b) a compound or mixture of compounds of formula (I)

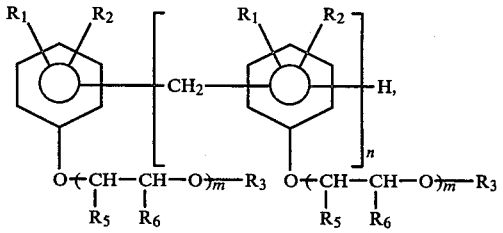

(I)

wherein each $R_1$, independently, is $C_{4-14}$alkyl, each $R_2$, independently, is hydrogen or $C_{1-10}$alkyl, with the proviso that the sum of the carbon atoms present in $R_1$ and $R_2$ borne by the same phenyl ring is from 6 to 18, the $R_3$'s are hydrogen, $—SO_3R_4'$ or $—CH_2CO_2R_4'$ with the proviso that an average of 0.5 to n/2 $R_3$'s are $—SO_3R_4'$ or $—CH_2CO_2R_4'$, each $R_4$, independently, is hydrogen, sodium, potassium, ammonium or one calcium or magnesium equivalent, either $R_5$ and $R_6$ are both hydrogen in each unit $—CHR_5—CHR_6—$ or in, on average, up to 60% of the units $—CHR_5—CHR_6—$ one of $R_5$ and $R_6$ is methyl and the other is hydrogen and in the remaining units $—CHR_5—CHR_6—$ both of $R_5$ and $R_6$ are hydrogen each m, independently, is an integer from 4 to 20, and n is an integer from 1 to 9 in a weight ratio of (a) to (b) from 60:40 to 90:10.

18. A composition according to claim 17 wherein (a) is a carrier, a dyeing accelerator or a leveling agent.

19. A composition according to claim 17 wherein the dyeing assistant is a carrier selected from (a) mixtures of alkylbenzenes having a boiling point range above 140° C., (b) the product of mono- or polyesterifying an aliphatic polyol or ether-polyol or a disaccharide with benzoic acid or benzoic acid substituted on the phenyl ring by up to three substituents selected from chlorine, $C_{1-4}$alkyl and $C_{1-4}$alkoxy, (c) a $C_{1-2}$alkyl-, $C_{1-4}$alkoxy $C_{1-6}$alkyl-, benzoyloxy $C_{1-6}$alkyl- or cycloalkyl ester of phthalic acid or phthalic acid monosubstituted on the benzene nucleus by chlorine, $C_{1-3}$alkyl or $C_{1-2}$alkoxy, and mixtures thereof, and, in formula (1), $R_1$ is octyl, nonyl or dodecyl, $R_2$ is hydrogen or methyl, and 1 to n/2 $R_3$'s are $—SO_3R_4'$ or $—CH_2CO_2R_4'$ and the remaining $R_3$'s are hydrogen.

20. A composition according to claim 18 wherein, in formula (I)

each $R_1$, independently, is straight chain $C_{6-12}$alkyl, each $R_2$, independently, is hydrogen or $C_{1-6}$alkyl, each m independently, is an integer from 6 to 15, n is an integer from 1 to 6, all the units —$CHR_5$—$CHR_6$— are ethylene or an average of up to 40% of the units are 1,2-propylene and the remaining units are ethylene.

21. A composition according to claim 19 wherein, in formula (I)

each $R_1$ is nonyl, each $R_2$ is hydrogen, an average of 1 $R_3$ is —$SO_3H$ and the remainder are hydrogen each m, independently, is an integer such that the total of the m's is 50, and n is 6.

22. A composition according to claim 20 wherein (a) is a carrier selected from the group consisting of chlorinated aromatic hydrocarbons, alkylbenzenes, diphenyl, diphenylether, ditolylether, methylnaphthalene, o-phenylphenol, p-phenylphenol, cyclohexylphenol, dibenzofuran, benzyl benzoate, $C_{1-2}$alkyl benzoates and mono- and polyesterification products of polyols with benzoic acid.

23. A composition according to claim 22 wherein the weight ratio of (a) to (b) is from 70:30 to 85:15.

24. A composition according to claim 22 wherein, in formula (I), $R_1$ is octyl, nonyl or dodecyl, $R_2$ is hydrogen or methyl and 1 to n/2 $R_3$'s are —$SO_3R_4'$ or —$CH_2CO_2R_4'$ and the remaining $R_3$'s are hydrogen.

25. A composition according to claim 24 wherein, in formula (I)

each $R_1$ is nonyl, each $R_2$ is hydrogen, an average of 1 $R_3$ is —$SO_3H$ and the remainder are hydrogen, each m, independently, is an integer such that the total of the m's is 50, and n is 6.

* * * * *